United States Patent [19]

Chen et al.

[11] 4,302,324

[45] Nov. 24, 1981

[54] DELAYED COKING PROCESS

[76] Inventors: Nai Y. Chen, Forrest Central Dr., R.D., Titusville, N.J. 08560; Dennis E. Walsh, 36 Redwood Dr., Richboro, Pa. 18954

[21] Appl. No.: 163,835

[22] Filed: Jun. 27, 1980

[51] Int. Cl.[3] ..... C10G 9/14

[52] U.S. Cl. ..... 208/131

[58] Field of Search ..... 208/131

[56] References Cited

U.S. PATENT DOCUMENTS

| | | | |
|---|---|---|---|
| 3,116,231 | 12/1963 | Adee | 208/131 |
| 3,173,852 | 3/1965 | Smith | 208/131 |
| 4,082,650 | 4/1978 | Li | 208/131 |

*Primary Examiner*—O. R. Vertiz

*Assistant Examiner*—Wayne A. Langel

*Attorney, Agent, or Firm*—Charles A. Huggett; Michael G. Gilman; Charles J. Speciale

[57] ABSTRACT

A delayed coking process in which part of the coke produced is heated by partial burning and mixed with preheated coker feedstock to raise the temperature of the coking mass present in the coking drums. The rapid heat transfer thus obtained brings about some immediate flashing of volatiles and makes possible higher than usual temperatures in the coking drums. The results are a reduction of residence time in the drums and an increase in the yield of volatile products. Hot coke in excess of that required to heat the feed may be gasified. Thus, resultant net coke yields are lower than the conventional delayed coking process.

9 Claims, 1 Drawing Figure

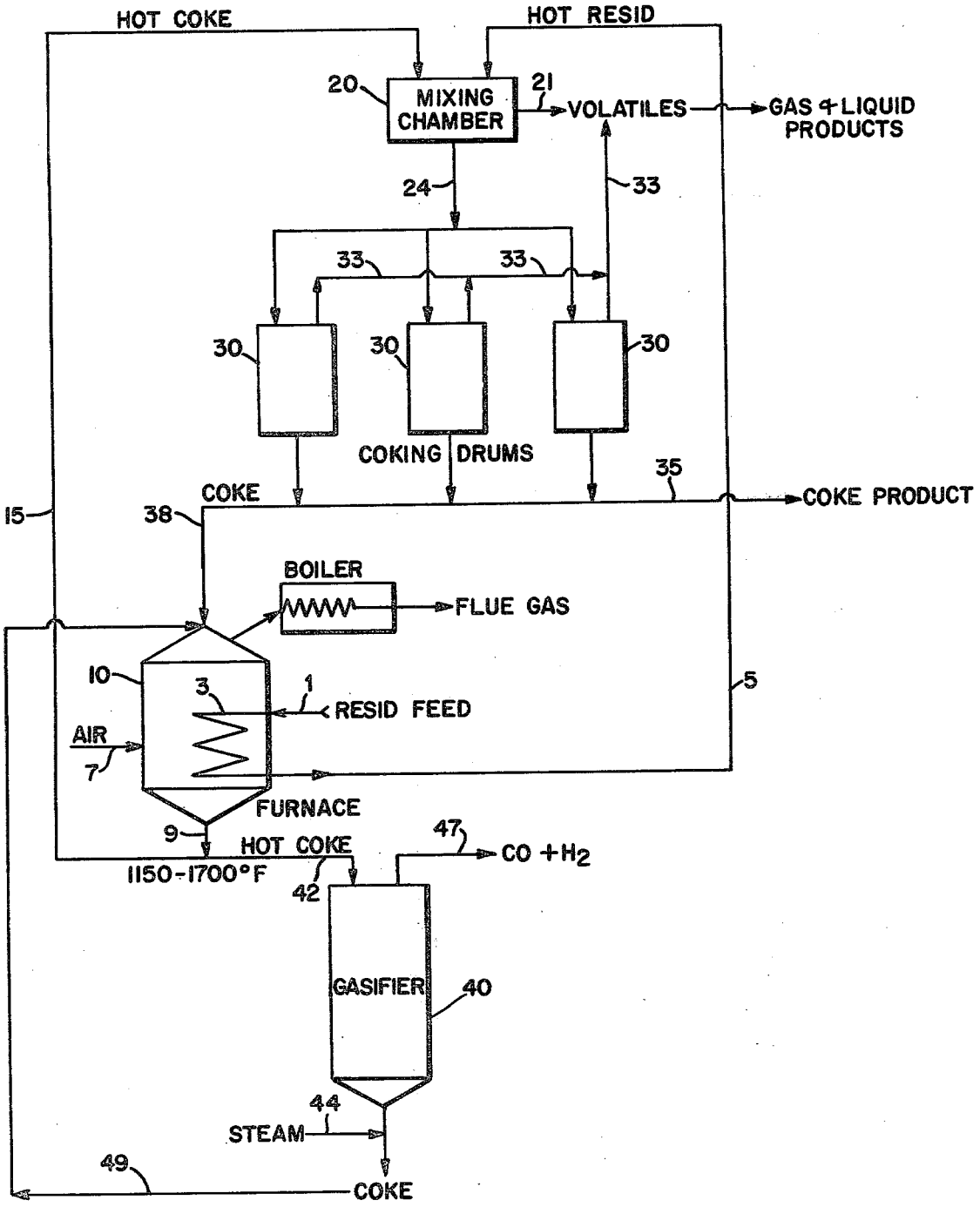
HOT COKE
HOT RESID
20
MIXING CHAMBER
21
VOLATILES
GAS + LIQUID PRODUCTS
24
33
33
33
30
30
30
COKING DRUMS
35
COKE PRODUCT
15
38
COKE
BOILER
FLUE GAS
10
3
1
RESID FEED
5
AIR
7
FURNACE
9
HOT COKE
1150-1700°F
42
47
CO + H2
GASIFIER
40
44
STEAM
49
COKE

DELAYED COKING PROCESS

BACKGROUND OF THE INVENTION

1. Field of the Invention

This invention relates to the coking of heavy petroleum fractions or residues. More particularly, this invention relates to heat generation and transfer in delayed coking processes and to subsequent treatment of the delayed petroleum coke product.

2. Description of Prior Art

Delayed cokers are furnace-type coking units wherein the feed is rapidly heated to temperatures at which it will thermally decompose and the effluent from the furnace discharges (before decomposition) into a large "coke drum", where it remains until it either cracks and passes off as vapor or condenses into coke.

In the usual application of the delayed coking process, residual oil is heated by exchanging heat with liquid products from the coking process and is then fed into a fractionating tower where any light products which might remain in the residual oil are distilled out. The oil is then pumped through a furnace where it is heated to the required temperature and discharged into the bottom of the coke drum. The first stages of thermal decomposition reduce this oil to a very heavy tar or pitch which further decomposes into solid coke. The vapors formed during this decomposition produce pores and channels in the coking mass through which the incoming oil from the furnace may pass. This process continues until the drum is filled with a mass of coke. The vapors formed in the process leave from the top of the drum and are returned to the fractionating tower where they are fractionated into desired cuts.

The delayed coking heater outlet temperature is controlled in the temperature range of 900° to 950° F. Higher temperatures may cause rapid coking in the coking heater and shortened on-stream time. Lower temperatures produce soft coke with a high VCM content. Sufficient pressure to avoid vaporization of the feed is maintained in the heater. The residence time must be long enough to bring the oil up to the desired temperature but excess time in the heater may cause coking and result in clogging the heater coil. A method frequently used for controlling the velocity and residence time in the heating coil is to inject water (or steam) into the high-boiling petroleum oil entering the heating coil. Water or steam injection is controlled at a rate sufficient to maintain the oil velocity in the heating coil to prevent coke from forming and depositing in the coil. Nevertheless, it has not been possible to raise the temperature of residual oil charged to the coking drum above about 950° F. without encountering unacceptable rates of coke deposition in the coker heating means.

Coke formation reactions are essentially endothermic with the temperature dropping to 780° to 900° F., more usually to 780° to 840° F., in the coke drum. Coke drum pressures are maintained in the range from 10 to 70 psig.

To avoid the temperature limitations of delayed coking units, both moving bed and fluidized bed units have been proposed for reduced crude coking operations. Because they generally operate at lower pressures and higher temperatures than delayed cokers, more of the feed charge to fluid and contact or moving bed cokers is vaporized. The higher temperatures of fluid and contact or moving bed units also result in higher octane gasoline than that from delayed coking and in more olefinic gases. However, despite the development of these higher temperature coking processes, most commercial coking operations currently employ the delayed coking process.

The principal charging stocks for coking operations are high boiling virgin or cracked petroleum residues which may or may not be suitable as heavy fuel oils. An important use of coke is as domestic or industrial fuel although a substantial tonnage is processed and used in making carbon or graphite electrodes for use in the metals industries. However, the dynamic manner in which fluid coke is formed yields a solid product having physical properties which make it undesirable for this latter application. Delayed coking, on the other hand, when processing a sufficiently aromatic feedstock, can provide a premium quality coke product.

A primary objective of all of the various known coking processes has been to convert as large a proportion as possible of the feedstock to lighter hydrocarbon fractions while keeping coke formation to a minimum. The coker feedstock is completely converted to lighter and heavier materials. The lighter products (resulting from cracking) are gas, some gasoline, and gas oil. The heavier product (resulting from condensation reactions) is coke. The various product yields are affected by the coking tendency of the charge stock (e.g., as indicated by the Conradson Carbon Number), by the process employed (delayed or fluid) and by the process conditions. The yield of distillates is maximized by coking at low pressures. At higher pressures more gas and coke are produced, and the liquid product contains more gasoline. The yields of gas and gasoline also increase with increasing temperatures; the yield of gas oil decreases. Moreover, the research octane number of the gasoline increases linearly with temperature: for example, from 72° at 930° F. to 87° at 1057° F. Gasolines produced at higher temperatures are unstable and require finishing operations such as clay treating or mild hydrogenation. The gases produced at higher temperatures are more olefinic: at an average temperature of 955° F. they are 50% olefinic, as compared with 15% at temperatures of about 850° F.

Present delayed coker reactors must be operated within a relatively narrow range of conditions which limits the degree of control over product yield distribution and over product qualities. As noted above, a principle limitation of delayed cokers is the furnace outlet temperature which in turn limits the temperatures in the delayed coking drums. This limitation is of relatively minor importance in plants where the more valuable gaseous and liquid products produced by delayed coking are a relatively small percentage of the total volume of similar products produced in the complete refinery. However, improved product flexibility would be a considerable asset to the process and is particularly important in refineries processing heavy crudes such that the coker products have a major influence on overall refinery yields. Inasmuch as high quality crudes are becoming increasingly scarce and expensive, the processing of heavy crudes is becoming increasingly important today.

Accordingly, a principal object of the present invention is an improved delayed coking process having enchanced temperature flexibility. A related object is to provide a delayed coking process wherein the temperature of the resid charge may be raised rapidly to at least 50° F. above the maximum temperature achievable by conventional delayed coking processes. An attendant increase in coke drum temperature would also ensue. A further object is to increase gas and liquid yields from delayed coking processes without sacrificing the highly desirable properties of delayed petroleum coke product. These objects and others apparent from this specification are accomplished by adding hot coke to feed charged to the coking drum of delayed coking units.

Although addition of heat carrying solids to raise the coke drum temperature has not been suggested by the prior art, addition of solids such as coke to coking feedstocks is generally known. U.S. Pat. No. 3,673,080 suggests dispersing particulate carbon in a delayed coker feed, heating the resulting mixture in a heater to about 900°-930° F. and charging the heated mixture to a coke drum. Clusters of spheroidal-shaped, solid petroleum coke pellets having improved compressive strength are said to be produced. U.S. Pat. No. 3,704,224 suggests adding relatively small quantities (0.2-20 ppm weight) of graphite particles to heated coker feedstock as it passes from the furnace to the coking drum (column 3, lines 4-9) to improve the qualities of the delayed coke product.

U.S. Pat. No. 3,116,231 described a delayed coking process wherein coke fines, formed by attrition when decoking the drums, are slurried with a gas oil stream and added to the heated feedstock stream as it enters the delayed coke drums. U.S. Pat. No. 4,082,650 teaches that coke yield and quality may be improved if the fines are at a temperature approximately equal to the temperature of the liquid feedstocks and are added to the coke drums either prior to the addition of liquid feedstock or continuously during the coking operation. The examples of the '650 patent show that coking when fines are added according to the process disclosed therein yields results which are substantially equivalent to those obtained when no fines were added. Furthermore no claim is made that either the temperature of the added coke or the amount of heated coke results in any appreciable enhancement of coker feed and drum operating temperature.

U.S. Pat. No. 2,717,865 teaches adding a naphtha-boiling range diluent and seed solids to a heavy oil feed prior to heating the feed to coking temperatures to prevent coke deposition on apparatus surfaces in systems for the liquid phase coking of heavy hydrocarbonaceous residues. A two-stage coking process wherein the first stage is similar to that of the '865 patent is disclosed in U.S. Pat. No. 2,899,376.

SUMMARY OF THE INVENTION

Conventional delayed coking processes, when compared with fluid or moving bed coking processes operate at lower temperatures and produce higher quality liquid and solid products. However, because its operating temperature is limited by the capability of the furnace to heat the oil without excessive coke laydown in the heating coils, the liquid yield is significantly lower than that produced by the fluid coking process. The present invention is a method of increasing liquid yields of delayed cokers without adversely affecting the coker's ability to produce high quality coke.

The method comprises burning a portion of the coke product to raise its temperature to about 1150° to 1750° F. and mixing the hot coke particles with pre-heated residual oils charge so as to raise the temperature of the charge rapidly by at least 50° F. Coking drum temperature will also increase in accordance with higher initial feed temperature. The ratio of hot coke particles to heated residual oil is generally within the range from about 0.1-2 pounds coke per pound feed, and is preferably within the range from about 0.2-0.5. Coke products recovered from the drums have a lower volatile content and improved mechanical strength relative to conventional delayed coke. Furthermore, the yield of volatile products is increased by 10% or more.

BRIEF DESCRIPTION OF THE DRAWINGS

The FIGURE is a schematic drawing of a preferred embodiment of the process of this invention.

DETAILED DESCRIPTION OF THE INVENTION

Selection of a suitable charge stock or feed stock for the coking operation is well known in the art. Principle charge stocks are high boiling virgin or cracked petroleum residua such as virgin reduced crude, bottoms from vacuum distillation (vacuum reduced crude), thermal tar or other residue and blends thereof.

Similarly, operation of the coker heater is well known in the art: feedstock is pumped through a coker heating means at about 150-500 psig and heated to a temperature of about 850°-950° F. Effluent from the coker heater means is referred to herein as "heated coker feedstock".

One approach for mixing the hot coke particles at a temperature from about 1150° to 1750° F. with heated coker feedstock is to add hot coke to the heated coker feedstock just before the feedstock enters the coking drum. The addition may occur in a separate mixing zone. Substantial coking is avoided in the mixing zone by maintaining a short residence time therein relative to the drum residence time. Slurry residence time in the mixing zone should be less than about 3% of the drum residence time, or within the range of about 1 min. to 45 min., preferably within the range of about 5 min. to 15 min. Pressures in the mixing zone should be within the range from about 10 psig to 300 psig. Slurry transport to the coking drum may be accomplished by means such as centrifugal or reciprocating pumps or by screw conveyers. This mixing mode may be employed when the hot coke to heated coker feedstock ratio is about 0.2 to 0.5 pounds per pound—i.e., when the slurry is predominately liquid. The slurry may be introduced to the coke drum at the top or bottom. Introduction to the bottom of the coke drum, as in conventional delayed coking, is preferred so that volatiles that are released may be passed upwardly through the coking mass to obtain a relatively porous structure through which additional slurry feed may pass.

In another approach, the coke drum itself becomes the mixing zone. Heated coker feedstock is charged to the bottom of the delayed coking drum as in conventional units while hot coke particles are introduced at the top of the drum and "rain down" upon the incoming feedstock and forming coke mass. "Raining solids" systems are well known in the art and adaptation of delayed coking drums for such an operation is within the skill of the art.

The weight ratio of hot coke particles to heated coker feedstock is generally within the range of about 0.1-2:1 and preferably within the range from about 0.2 to 0.5:1. Selection of a ratio for a particular application of the process of this invention will depend on the method employed for mixing the coke and feedstock, the temperature of the heated coker feedstock, the temperature of the hot coke particles, and the desired temperature of the charge oil and resultant coking mass in the coking drum. As previously stated, the temperature of the heated coker feedstock will usually be within the range from about 850° to 950° F. However, lower temperatures may be employed since the relatively higher coke particle temperatures will be sufficient to raise the coker feedstock to "conventional" temperatures and higher. The temperature of the hot coke particles is generally within the range from about 1150° to 1750° F., preferably within the range from 1300° F. to 1650° F.

The table presented below provides some information on the slurry temperature which may be expected when preheated oil and hot coke are mixed in the proportions shown. Drum temperatures may be expected to decline about 80° F. below the values shown over the delayed coking cycle.

SLURRY TEMPERATURE OF PREHEATED RESID (930° F.) AND HOT COKE

| | Coke/Oil Weight Ratio | | |
|---|---|---|---|
| Coke Temp. | 0.2 | 0.35 | 0.5 |
| 1575° F. | 980° F. | 1012° F. | 1042° F. |
| 1750° F. | 993° F. | 1035° F. | 1072° F. |

When a "raining" solids technique is used instead of a mixing zone, the falling hot solids will enchance secondary cracking reactions (to lighter products) of rising vapors released from the forming coke mass and, upon impact into the mass, will increase the local temperatures and thus further effect volatiles release and cracking.

The hot coke particles are formed by burning a portion of the delayed petroleum coke product in a combustion zone similar to those employed in fluid and moving bed coking processes. Preferably a moving bed combustion zone is used, although fixed or fluidized bed combustion may also be used.

The combustion zone of the process of this invention may be advantageously combined with other elements of the delayed coking process and with subsequent coke gasification. In one embodiment of this invention, a portion of the hot coke produced in the combustion zone is gasified to yield synthesis gas for the production of hydrocarbons or hydrogen. In another embodiment of this invention, the combustion zone replaces the conventional coking furnace for preheating the charge stock. Heat transfer may occur in the combustion zone itself—e.g., by passing delayed coker feed stock through tubes immersed in a moving or fluidized bed of coke particles maintained in the combustion zone—or in a separate heat transfer zone—e.g., by passing flue gas from the combustion zone to a heat exchange means. The former method of heat transfer wherein the combustion zone contains a moving bed of coke particles is preferred.

Referring now to the drawing, a preferred embodiment of the present invention will now be described.

Feedstock is introduced through line 1 into heating coils 3 immersed in a moving bed of coke contained in combustion zone 10. In the embodiment shown in the FIGURE, a portion of the delayed coke product withdrawn from coking drums 30 is burned in combustion zone 10 to heat the feedstock to temperatures in the range from about 850° to 950° F. However, the use of conventional delayed coker furnaced is also contemplated by the inventors. If desired, water or steam may be introduced in coils 3 along with the feedstock to minimize fouling or coke deposition in the coils.

Heated coker feedstock from the combustion zone 10 passes through line 5 to mixing zone 20 where hot coke solids at a temperature within the range from about 1150° to 1750° F. are added to the heated coker feedstock to raise the temperature of the resulting slurry by 50° F. or more. The weight ratio of hot coke to heated coker feedstock is described above. Conditions in mixing zone 20 are sufficiently turbulent to assure a high degree of solids/liquids contacting and the pressure is sufficient to maintain most of the fluid coke or feedstock in the liquid phase. Desirably, the pressure of the mixing zone 20 ranges from about 10 psig to 300 psig. Because thermal cracking of the feedstock is initiated and enhanced by rapid heating to the temperature attained therein, light volatile products will form and may be withdrawn from zone 20 through line 21. Residence time in the mixer is very short, usually in the range from about 1 minute to 45 minutes, and preferably from about 5 minutes to 15 minutes.

Slurry from mixing zone 10 at a temperature in the range from about 980° F. to 1050° F. passes through line 24 and is charged to a coking drum 30. A plurality of coking drums are employed as is known in the art. Depending upon the solids content and temperature of the slurry in line 24, it may be charged either at the top or bottom of drum 30. As discussed above, the slurry is preferably predominately liquid and is charged to the bottom of coke drum 30. In the drum the hot coke particles will initially be suspended in the upwardly swirling feed stream. As the charge fills the drum, liquid hydrocarbons crack, condense, and polymerize depositing layers of coke on the particles charged to the drum. At some point, pellet-sized particles will settle out by gravity and deposit on and fuse with other coke pellets at the bottom of the coke drum, forming a cluster of petroleum coke particles. The particles harden and the level of the coke bed rises until a mass of solid petroleum coke fills the drum. Volatile products evolved during the coking cycle are removed from the drums 30 through lines 33 and are processed according to known methods.

When the coking cycle is completed, the filled drums are decoked and delayed petroleum coke product 35 is recovered. A portion of the coke product is dried and ground to a particle size within the range from about 1 inch to 200 mesh, preferably from about 10 mesh to 80 mesh, and passes through line 38 to combustion zone 10 where it is burned with air introduced through line 7 in a moving bed to raise the coke temperature to about 1150° to 1750° F. and to heat the coker feedstock 1.

A first portion of the hot coke particles leaving combustion zone 10 through line 9 passes through line 42 to gasification zone 40 where it is reacted with steam introduced through line 44 to produce synthesis gas which in turn is withdrawn through line 47. If desired, air may be added along with steam 44 to provide heat for the gasification reaction. Steam or steam-air gasification of coke is well known in the art and the details thereof do not form a part of this invention. Unreacted coke is withdrawn from gasification zone 40 and is returned via line 49 to the combustion zone 10.

A second portion of the hot coke particles leaving combustion zone 10 through line 9 passes through line 15 to mixing zone 20 where it is mixed with feedstock 5 to raise the temperature of the resulting slurry 50° F. or more higher than the temperature of the liquid feedstock entering the mixing zone.

The coke produced according to the process of this invention is lower in volatiles and improved in mechanical strength relative to conventional delayed coke. The yield of liquid product is increased by 10% or more (based on resid feed). Because coke is recycled to the coking drum, more coke is processed through the coking drums than in the present practice of delayed coking. However, it is expected that the required capacity of coking drums used in the process of this invention could be smaller because of lower net coke production and shorter operating cycles.

What is claimed is:

1. In a process for producing delayed petroleum coke comprising heating a normally liquid hydrocarbon coker feedstock in a heating means to a temperature within the range from about 850° to 950° F., charging the resulting heated coker feedstock to a delayed coking drum and maintaining it therein at delayed coking conditions until petroleum coke is formed, and periodically recovering a petroleum coke product from the coke drum; the improvement wherein coke particles at a temperature within the range from about 1150° to 1750° F. are added to the heated coker feedstock to raise the temperature of the resultant mixture by at least 50° F. above the temperature of the heated coker feedstock, the weight ratio of coke particles to heated coker feedstock being in the range from about 0.1 to 2.0.

2. The process of claim 1 wherein a portion of the petroleum coke product periodically recovered from the coke drums is heated in a moving bed combustion zone to provide said hot coke particles.

3. The process of claim 2 wherein said heating means comprises the moving bed combustion zone.

4. The process of claims 2 or 3 wherein a first portion of the coke product heated in said moving bed combustion zone provides said hot coke particles and a second portion of the coke product heated in said moving bed combustion zone is gasified to produce synthesis gas.

5. The process of claims 1 or 2 wherein the particle size of said coke particles is within the range from about 1 inch to 200 mesh.

6. The process of claim 1 wherein the coke particles are added to the heated coker feedstock in a mixing zone wherein the residence time of the resulting slurry is within the range from about 1 to 45 minutes and charging the slurry to the delayed coking drum.

7. The process of claim 6 wherein the temperature of the slurry charged to the delayed coking drum is within the range from about 980° F. to 1400° F.

8. The process of claim 6 wherein the pressure in said mixing zone ranges from about 10 to 300 psig.

9. The process of claim 1 wherein the heated coker feedstock is charged to the bottom of the delayed coking drum and the hot coke particles are charged to the top of the delayed coking drum and rain down upon the forming coke mass at the bottom of the drum.

* * * * *